United States Patent [19]

Wassenhoven

[11] Patent Number: 4,660,374

[45] Date of Patent: Apr. 28, 1987

[54] OPEN-END ROTOR SPINNING MACHINE

[75] Inventor: Heinz-Georg Wassenhoven, Monchen-Gladbach, Fed. Rep. of Germany

[73] Assignee: W. Schlafhorst & Co., Monchen-Gladbach, Fed. Rep. of Germany

[21] Appl. No.: 892,820

[22] Filed: Aug. 1, 1986

[30] Foreign Application Priority Data

Aug. 3, 1985 [DE] Fed. Rep. of Germany ..... 3527943

[51] Int. Cl.[4] ..... D01H 1/135; D01H 7/882

[52] U.S. Cl. ..... 57/407; 57/404; 57/408; 57/417

[58] Field of Search ..... 57/406, 404, 407, 408, 57/415, 417

[56] References Cited

U.S. PATENT DOCUMENTS

| | | | |
|---|---|---|---|
| 4,245,460 | 1/1981 | Staufert et al. | 57/415 |
| 4,516,396 | 5/1985 | Stahlecker et al. | 57/407 |
| 4,570,435 | 2/1986 | Stahlecker | 57/406 X |

*Primary Examiner*—John Petrakes

*Attorney, Agent, or Firm*—Herbert L. Lerner; Laurence A. Greenberg

[57] ABSTRACT

An open-end rotor spinning machine includes a multiplicity of spinning boxes disposed side by side on a machine frame at spinning stations; each of the spinning boxes including: a basic frame, a first shaft disposed on the basic frame, a spinning rotor having a rotor plate being disposed on the first shaft, a rotor housing surrounding the rotor plate, a second shaft disposed on the basic frame substantially perpendicular to the first shaft, a lid-like insert covering an opening formed in the rotor housing and being pivoted about the second shaft for opening the spinning box, a thread withdrawal channel disposed on the lid-like insert, a thread withdrawal nozzle disposed on the thread withdrawal channel in the vicinity of an opening in the rotor plate, the thread withdrawal nozzle being pivotal on the second shaft out of the vicinity of the opening in the rotor plate in a given direction, a third shaft disposed on the basic frame, a bearing pivotally disposed on the third shaft, a fiber feeding and opening device disposed on the bearing below the rotor housing, and a one-piece fiber feeding channel disposed on the fiber feeding and opening device and having a discharge end in the vicinity of the opening in the rotor plate, the fiber feeding channel being pivotal on the third shaft out of the vicinity of the opening in the rotor plate in a direction different than the given direction.

12 Claims, 5 Drawing Figures

OPEN-END ROTOR SPINNING MACHINE

The invention relates to an open-end rotor spinning machine with a multiplicity of spinning boxes disposed on a machine frame, each spinning box including a shaft and a spinning rotor with a rotor plate surrounded by a rotor housing, the open front surface of the rotor housing having a lid-like insert with a thread withdrawal channel beginning at a thread withdrawal nozzle, the lid-like insert being pivotally connected to the basic frame of the spinning box for opening the spinning box of a spinning station by pivoting the lid-like insert about an axis essentially at a right angle to the axis of the shaft, and a feeding and opening device below the rotor housing supported on the basic frame of the spinning box, having a fiber feeding channel discharging in the spinning rotor, the end of the fiber feeding channel being movable out of the vicinity of the opening in the spinning rotor.

An open-end rotor spinning machine of this type is known from German Pat. No. DE-PS 32 47 411. In this conventional rotor spinning machine, the end region of the fiber feeding channel is moved or pivoted out of the vicinity of the opening of the rotor plate as the spinning box is opened, so that a cleaning device has access to the interior space of the rotor plate.

The feeding and opening device is supported at the spinning box and does not follow the pivoting motion of the lid-like insert. For this reason the fiber feeding channel has a sealed separating gap, which makes it possible for one part of the fiber feeding channel to be fixed to the spinning box, while the discharge part of the fiber feeding channel can swing away. Experience has shown that fibers can collect in the separating gap of the feeding channel and build up, forming a fiber bunch. These fibers can suddenly be sucked into the rotor plate, causing an irregularly spun thread and in the worst cases it can cause the spun thread to break.

German Pat. No. DE-PS 15 35 005 discloses a rotor spinning machine having a housing which is divided into two parts. One housing part contains the spinning rotor while the other part contains the feeding and opening device and the withdrawal nozzle. It thus becomes possible to construct the fiber feeding channel in one piece between the opening roller and the discharge of the fiber feeding channel in the rotor. However, the opening part of the housing is weighted down by the weight of the feeding and opening device. This causes centering problems as well as problems caused by using a carriage to start the spinning operation or to join a thread. In this case the carriage has to move the heavy, movable half of the housing out and in and place it in a precise location after a cleaning operation. Furthermore, in this conventional rotor spinning machine, the drive shafts of the opening and feeding rollers are vertical. Therefore, the plane of rotation of the loosening roller is essentially horizontal, which leads to difficulties, because gravitational forces cannot be utilized to eliminate dirt particles.

It is accordingly an object of the invention to provide an open-end rotor spinning machine, which overcomes the hereinaforementioned disadvantages of the heretofore-known devices of this general type, to prevent formation of fiber bunches and to additionally improve the positioning of the fiber feeding channel in relation to the rotor plate after a preceding cleaning or servicing operation at the rotor plate.

With the foregoing and other objects in view there is provided, in accordance with the invention, an open-end rotor spinning machine, comprising a machine frame having spinning stations; a multiplicity of spinning boxes disposed side by side on the machine frame at the spinning stations; each of the spinning boxes including: a basic frame, a first shaft disposed on the basic frame, a spinning rotor having a rotor plate being disposed on the first shaft and having an opening formed in the rotor plate, a rotor housing surrounding the rotor plate and having a front surface or side with an opening formed therein, a second shaft disposed on the basic frame substantially perpendicular or at a right angle to the first shaft, a lid-like insert covering the opening formed in the rotor housing and being pivoted about the second shaft for opening the spinning box, a thread withdrawal channel disposed on the lid-like insert, a thread withdrawal nozzle disposed on the thread withdrawal channel in the vicinity of the opening in the rotor plate, the thread withdrawal nozzle being pivoted with the thread withdrawal channel and the lid-like insert on the second shaft out of the vicinity of the opening in the rotor plate in a given direction, a third shaft disposed on the basic frame, a bearing pivotally disposed on the third shaft, a fiber feeding and opening or loosening device disposed on the bearing below the rotor housing, and a one-piece fiber feeding channel disposed on the fiber feeding and opening device and having a discharge end in the vicinity of the opening in the rotor plate, the fiber feeding channel being pivotal with the fiber feeding and loosening device and the bearing on the third shaft out of the vicinity of the opening in the rotor plate in a direction different than the given direction.

With this construction the weight of the feeding and opening device can be supported at the stable basic frame of the spinning box. Since the feeding and opening device is therefore moved together with the feeding channel, a precise return to the operating position is possible. Furthermore, by placing the feeding and opening device at the basic frame of the spinning box, the opening roller can be vertically disposed, which is advantageous for discarding dirt particles. Additionally, by separating the motions of the feeding channel and the withdrawal nozzle, an optimal alignment of very small spinning rotors can also be achieved. The weight of the part of the spinning box which has to be opened by a spinning starting or thread joining carriage is very small and carriages with lower power motors and less weight can be used.

In accordance with another feature of the invention, the third shaft is a hollow shaft, and including a feeding roller of the feeding and opening device and a drive shaft of the feeding roller extending through the hollow third shaft. In this way, not only is the space requirement of the pivoting apparatus very small, but it also makes it possible to place the opening roller and along with it the fiber feeding channel, sufficiently far from the pivot axis, so that a small angular motion results in a sufficiently wide displacement of the end of the fiber feeding channel from the vicinity of the opening of the rotor.

In accordance with a further feature of the invention, there is provided a service side of the machine from which the spinning box opens, the first and third shafts having axes forming an angle of between 25° and 45° with each other at an imaginary intersection thereof at the service side of the machine. In this way, the fiber feeding channel can be set to a favorable angle with respect to the rotor.

In accordance with an added feature of the invention, the fiber feeding channel pivots through a given range, and including means for positioning the fiber feeding channel in different angular positions within the range for optimum alignment with spinning rotors having different diameters. By using rotors with a small diameter, the motion from the center of the rotor to the edge of the rotor can be very small.

In accordance with an additional feature of the invention, the rotor plate has an edge bordering the opening formed therein, and the fiber feeding channel is disposed in a position on the fiber feeding and opening device placing the discharge end of the fiber feeding channel in the vicinity of the edge of the rotor plate. This is done in order to avoid motion perpendicular to the plane of the opening of the rotor.

In accordance with again another feature of the invention, the rotor plate has an edge bordering the opening formed therein, and the fiber feeding channel is disposed in a position on the fiber feeding and opening device placing the discharge end of the fiber feeding channel directly in front of the edge of the rotor plate. This is necessary for very small rotors. In any case, it is necessary for enough kinetic energy to be supplied to the fibers in the feeding channel to enable the fibers to penetrate the boundary layer flow of the rotor plate which rotates with high speed.

In accordance with again a further feature of the invention, the rotor, housing has a tubular section at an end thereof, and the lid-like insert has a sealing disc substantially air-tightly covering the tubular section.

In accordance with again an added feature of the invention, the third shaft is disposed at a given angle relative to the first shaft, and the tubular section is in the form of a circular hollow cylindrical section disposed at substantially the given angle relative to the first shaft.

In accordance with again an additional feature of the invention, the tubular section is divided into a wall region integral with the fiber feeding channel and a remaining region by parting gaps disposed along radii of the third shaft, the fiber feeding channel being extended through the tubular section and pivoted away from the remaining region with the wall region. This results in a good seal between the fiber feeding channel and the rotor housing.

In accordance with yet another feature of the invention, the machine has a service side, the opening in the rotor plate is in a given plane, and including means for causing the lid-like insert to pivot the feeding and opening device and to pivot the fiber feeding channel from an operating position to a position rendering the given plane freely accessible as the lid-like insert pivots toward the service side of the machine exposing the opening in the rotor housing.

In accordance with yet a further feature of the invention, the fiber feeding and opening device includes a housing, the housing has a guide contour formed thereon and the lid-like insert has a counterpart formed thereon being eccentric to the third shaft, engaging each other as the lid-like insert opens and closes the opening in the rotor housing and forcing the fiber feeding channel out of the path of the thread withdrawal nozzle and back into an operating position at the rotor plate. This is done because especially with small rotor diameters, during the pivoting motion of the suction channel, its suction nozzle end and the end of the fiber feeding channel are spaced close to each other and do not permit the motion of the withdrawal nozzle.

In accordance with a concomitant feature of the invention, the fiber feeding and opening device has a housing and the fiber feeding channel is detachably connected to the housing of the fiber feeding and opening device. This is advantageous because it is a part which is subjected to wear.

Other features which are considered as characteristic for the invention are set forth in the appended claims.

Although the invention is illustrated and described herein as embodied in an open-end rotor spinning machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
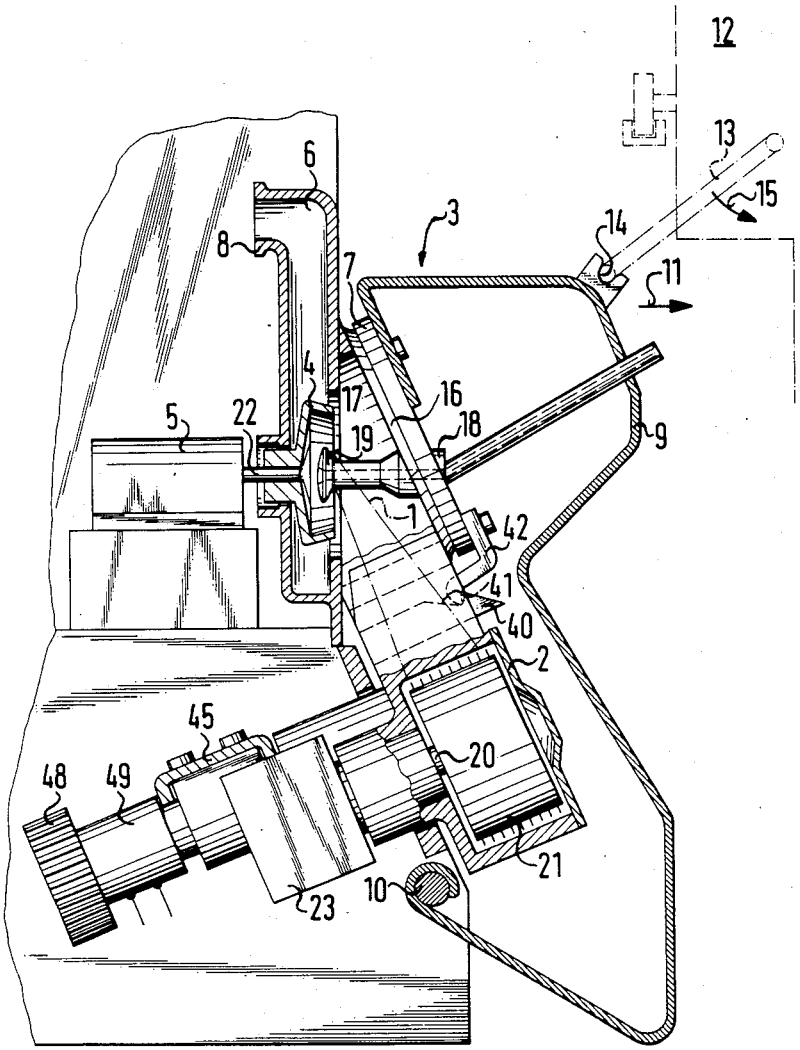
FIG. 1 is a fragmentary, diagrammatic, vertical-sectional view of a spinning box with a closed rotor housing, in which only parts that are important for an understanding of the invention are shown.

Referring now to the figures of the drawings in detail and first, particularly, to FIG. 1 thereof, there is seen a fiber feeding channel 1 of a feeding and opening or loosening device 2, which is indicated by phantom lines because it lies outside of the section plane of the figure. A spinning rotor with a rotor plate 4 and a bearing or drive 5 thereof, is shown in a spinning box which has a basic frame and which is designated as a whole with reference numeral 3. A rotor housing 6 is covered with a lid-like insert 7. A suction air connection 8 is provided at the rotor housing 6. The lid-like insert 7 is fastened to a cover 9, which can swing open about a second shaft 10 of three shafts toward the service side, in the direction of an arrow 11. The opening of the spinning box 3 is performed by a spinning starting or thread joining carriage 12, which engages a lever 13 in a complementary or mating groove 14 in the cover 9. As the lever 13 moves in the direction of an arrow 15, the cover 9 opens. The spinning starting or thread joining carriage 12 travels along all of the spinning boxes of the rotor spinning machine and among other functions, takes care of starting the spinning operation or joining the thread and cleans the spinning box, especially the rotor. For this purpose, the carriage has a non-illustrated device for knotting or splicing the thread as well as a device for cleaning the spinning rotor or the rotor groove. The lid-like insert 7 lies on an end region 17 of the rotor housing 6 along with a sealing disc 16 and is perforated by a thread withdrawal channel 18. The channel 18 discharges with a thread withdrawal nozzle 19 in the spinning rotor 4. As shown, the feeding and opening or loosening device 2 is disposed below the spinning rotor 4. A shaft 20 of an opening or loosening roller 21 forms an angle of about 30° with the axis of a first rotor shaft 22 at an intersection which can be visualized at the service side. A drive whorl or wharve 23 of the opening roller 21 extends into the interior of the spinning box 3 and therefore can be driven in a simple way by a tangential belt. The bearing of the feeding and opening or loosening device is described in connection with FIG. 5.

Figure 2:
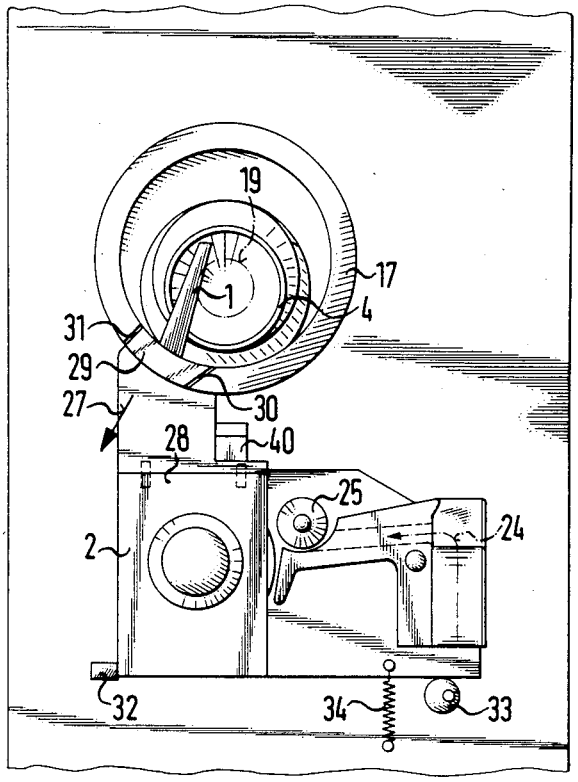
FIG. 2 is a fragmentary, top-plan view of FIG. 1 showing a spinning rotor and a feeding and opening or loosening device without a cover which protects these elements during operation.

FIG. 2 is a view of the feeding and opening or loosening device 2 and the rotor plate 4 of the spinning rotor, as seen in the direction of the shaft 20 of the opening roller 21, in which the cover 9 is not shown. Sliver is conducted to a feeding roller 25 in the direction of a dot-dash line 24 and is transported by the feeding roller 25 to the vicinity of the opening roller 21. The whole unit formed of the feeding and opening device/fiber feeding channel is pivotally supported on a third shaft 26 shown in FIG. 5 which is parallel to the shaft 20. The fiber feeding channel 1 can therefore swing out in the direction of an arrow 27 from the opening region of the rotor plate 4 of the spinning rotor. Thus, the interior of the rotor plate of the spinning rotor is fully accessible for cleaning purposes and in particular the rotor groove can be cleaned of adhering fiber remnants. The cleaning is done automatically during each thread joining or spinning starting operation. FIG. 2 also shows that the fiber feeding channel is connected with the housing of the feeding and opening device by a detachable plug connection at reference numeral 28, for example. Since the channel 1 is a part which is subject to wear, it can be easily exchanged due to this feature.

A wall region 29 of an end section 17 of the rotor housing 6 through which the fiber feeding channel 1 extends, is integral with the channel 1. In order to make it possible to swing out the fiber feeding channel 1 from the opening region of the rotor plate 4 of the spinning rotor, parting or separating gaps 30, 31 are provided in the end section 17 of the rotor housing 6, and an additional gap is provided between the region 29 and a non-illustrated peripheral wall of the end region 17. These gaps extend along radii with respect to the pivot shaft 26. As the cover 9 is opened, a non-illustrated linkage acts on a stop 32 and therefore pivots the assembly formed of the fiber feeding channel and the feeding and opening device about the shaft 26. The assembly is thereby lifted from a stop 33 onto which it is pulled by a spring 34. Normally, the whole assembly only moves far enough so that the plane of the opening of the spinning rotor is completely cleared. In this position, the spinning starting or thread joining carriage 12 can automatically clean fiber remnants from the rotor groove at each spinning start or thread joining operation. The stop 33 is eccentrically constructed, so that the outlet of the fiber feeding channel 1 can be optimally aligned with spinning rotors of different diameters.

Figure 3:
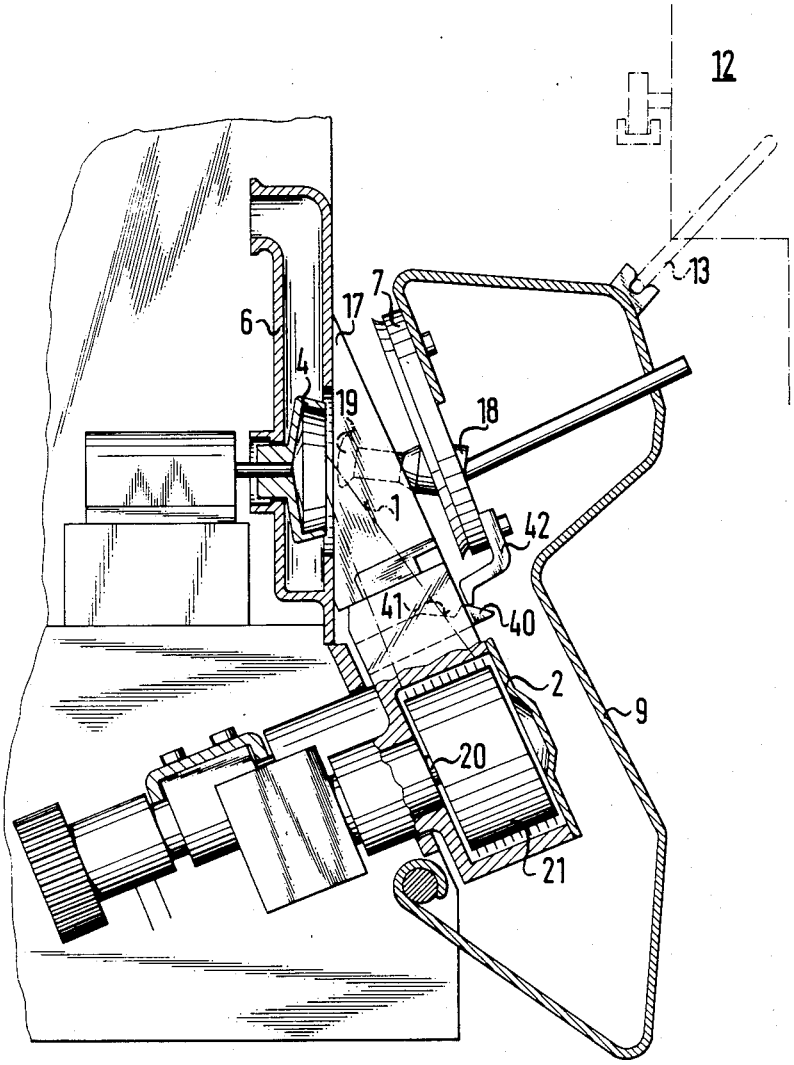
FIG. 3 is a view similar to FIG. 1, showing the spinning box with the lid-like insert half open.
Figure 4:
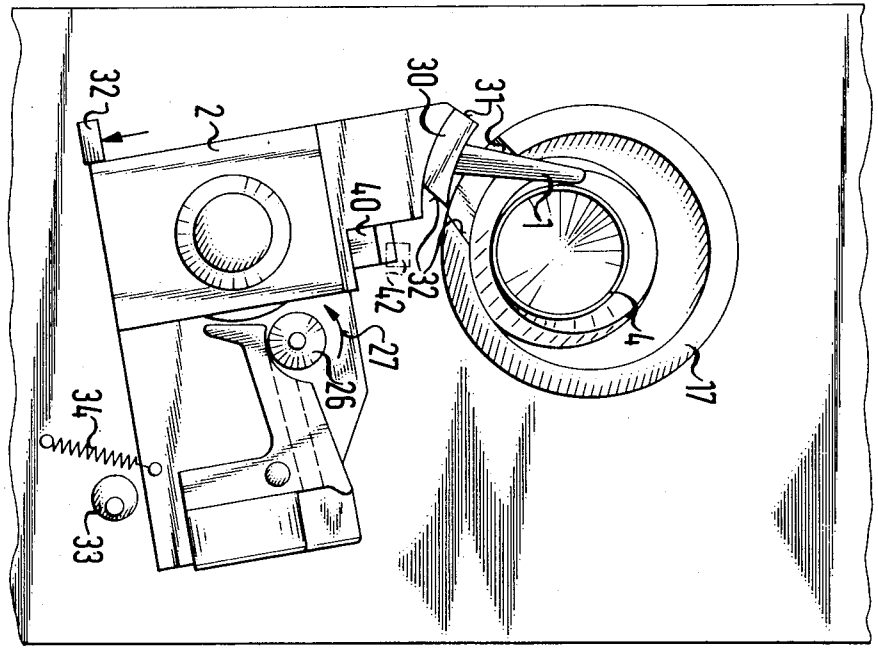
FIG. 4 is a view similar to FIG. 2 showing the spinning rotor and the feeding and opening or loosening device with a fiber feeding channel swung-out from the opening region of the spinning rotor.

FIGS. 3 and 4 correspond to FIGS. 1 and 2, with all of the components shown therein. In FIG. 3, the cover 9 has just been lifted from the end region 17 of the rotor housing at the beginning of the movement, while in FIG. 4 the assembly of the fiber feeding channel and the fiber feeding and opening device has been pivoted far enough so that the plane of the spinning rotor has been cleared.

FIG. 2 in connection with FIG. 3 shows that the fiber feeding channel 1 and the thread withdrawal nozzle 19 would interfere with each other in the opening plane of the spinning rotor during the pivoting motion. In order to prevent this interference at the housing of the feeding and opening device 2, a lever 40 is provided, which has a guide contour 41. A counterpart 42 engages the guide contour and moves the fiber feeding channel 1 out of the path of the thread withdrawal nozzle 19 as they approach each other during their pivoting motion. After the thread withdrawal nozzle 19 has passed the crossing point, the fiber feeding channel 1 returns to its operating position at the spinning rotor. The thread withdrawal nozzle 19 can also be flattened in the region thereof facing toward the fiber feeding channel.

In certain cases it is possible to introduce the thread withdrawal nozzle eccentrically or off-center into the spinning rotor, which would avoid crossing the path of the nozzle with the fiber feeding channel. With very small rotors which are used to allow very high rotary speeds, the thread withdrawal nozzle is already eccentrically disposed in order to save space. In this case, the fiber feeding channel 1 must pivot out of the path in which the thread withdrawal nozzle pivots.

Figure 5:
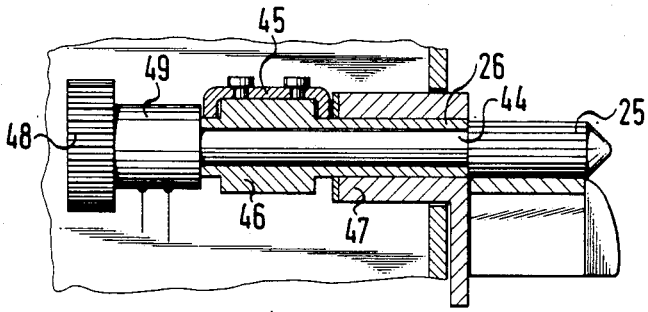
FIG. 5 is a fragmentary, longitudinal-sectional view through a pivot axis bearing of the fiber feeding channel/feeding and opening or loosening device unit.

FIG. 5 shows that a drive shaft 44 of the feeding roller 25 is fixed to the spinning box 3 by a U-shaped connection bracket 45 and a bearing housing 46. The connection bracket 45 is welded to the non-illustrated side walls of the spinning box. The bearing housing 46 extends to the vicinity of the feeding roller 25 and the forward part thereof forms the hollow shaft 26 which carries the housing 47 of the feeding and opening device. A pinion 48 engages a worm wheel of a drive shaft which services all of the spinning boxes. The pinion can be coupled with the drive shaft 44 by an electrically engaged and disengaged clutch 49, so that the sliver supply can be stopped, if the spinning operation is interrupted.

I claim:

1. Open-end rotor spinning machine, comprising a machine frame having spinning stations; a multiplicity of spinning boxes disposed side by side on said machine frame at said spinning stations; each of said spinning boxes including: a basic frame, a first shaft disposed on said basic frame, a spinning rotor having a rotor plate being disposed on said first shaft and having an opening formed in said rotor plate, a rotor housing surrounding said rotor plate and having a front surface with an opening formed therein, a second shaft disposed on said basic frame substantially perpendicular to said first shaft, a lid-like insert covering said opening formed in said rotor housing and being pivotal about said second shaft for opening said spinning box, a thread withdrawal channel disposed on said lid-like insert, a thread withdrawal nozzle disposed on said thread withdrawal channel in the vicinity of said opening in said rotor plate, said thread withdrawal nozzle being pivotal with said thread withdrawal channel and said lid-like insert on said second shaft out of the vicinity of said opening in said rotor plate in a given direction, a third shaft disposed on said basic frame, a bearing pivotally disposed on said third shaft, a fiber feeding and opening device disposed on said bearing below said rotor housing, and a one-piece fiber feeding channel disposed on said fiber feeding and opening device and having a discharge end in the vicinity of said opening in said rotor plate, said fiber feeding channel being pivotal with said fiber feeding and loosening device and said bearing on said third shaft out of the vicinity of said opening in said rotor plate in a direction different than said given direction.

2. Open-end rotor spinning machine according to claim 1, wherein said third shaft is a hollow shaft, and including a feeding roller of said feeding and opening device and a drive shaft of said feeding roller extending through said hollow third shaft.

3. Open-end rotor spinning machine according to claim 1, including a service side of the machine from which said spinning box opens, said first and third shafts having axes forming an angle of between 25° and 45° with each other at an imaginary intersection thereof at said service side of the machine.

4. Open-end rotor spinning machine according to claim 1, wherein said fiber feeding channel pivots through a given range, and including means for positioning said fiber feeding channel in different angular positions within said range for optimum alignment with spinning rotors having different diameters.

5. Open-end rotor spinning machine according to claim 1, wherein said rotor plate has an edge bordering said opening formed therein, and said fiber feeding channel is disposed in a position on said fiber feeding and opening device placing said discharge end of said fiber feeding channel in the vicinity of said edge of said rotor plate.

6. Open-end rotor spinning machine according to claim 1, wherein said rotor plate has an edge bordering said opening formed therein, and said fiber feeding channel is disposed in a position on said fiber feeding and opening device placing said discharge end of said fiber feeding channel directly in front of said edge of said rotor plate.

7. Open-end rotor spinning machine according to claim 1, wherein said rotor housing has a tubular section at an end thereof, and said lid-like insert has a sealing disc substantially air-tightly covering said tubular section.

8. Open-end rotor spinning machine according to claim 7, wherein said third shaft is disposed at a given angle relative to said first shaft, and said tubular section is in the form of a circular hollow cylindrical section disposed at substantially said given angle relative to said first shaft.

9. Open-end rotor spinning machine according to claim 7, wherein said tubular section is divided into a wall region integral with said fiber feeding channel and a remaining region by parting gaps disposed along radii of said third shaft, said fiber feeding channel being extended through said tubular section and pivotal away from said remaining region with said wall region.

10. Open-end rotor spinning machine according to claim 1, wherein the machine has a service side, said opening in said rotor plate is in a given plane, and including means for causing said lid-like insert to pivot said feeding and opening device and to pivot said fiber feeding channel from an operating position to a position rendering said given plane freely accessible as said lid-like insert pivots toward said service side of the machine exposing said opening in said rotor housing.

11. Open-end rotor spinning machine according to claim 1, wherein said fiber feeding and opening device includes a housing, said housing has a guide contour formed thereon and said lid-like insert has a counterpart formed thereon being eccentric to said third shaft, engaging each other as said lid-like insert opens and closes said opening in said rotor housing and forcing said fiber feeding channel out of the path of said thread withdrawal nozzle and back into an operating position at said rotor plate.

12. Open-end rotor spinning machine according to claim 1, wherein said fiber feeding and opening device has a housing and said fiber feeding channel is detachably connected to said housing of said fiber feeding and opening device.

* * * * *